US006568044B1

(12) United States Patent
Kidd

(10) Patent No.: US 6,568,044 B1
(45) Date of Patent: May 27, 2003

(54) ATTACHMENT DEVICE FOR PLIANT MATERIAL

(76) Inventor: Susan F. Kidd, 813 Miller Creek Rd., Allendale, SC (US) 29810

( * ) Notice: Subject to any disclaimer, the term of this patent is extended or adjusted under 35 U.S.C. 154(b) by 0 days.

(21) Appl. No.: 09/545,484

(22) Filed: Apr. 10, 2000

(51) Int. Cl.[7] ..... A44B 1/04; A44B 1/28

(52) U.S. Cl. ..... 24/104; 24/90.1

(58) Field of Search ..... 24/93, 94, 95, 24/101 R, 101 B, 103, 104, 106, 108, 114.4, 114.9, 114.05, 113.9, 113 R, 113 MP, 64, 572, 105, 107, 109, 706.2, 706.3, 707.6, 706; 40/315; 63/12, 29.1

(56) References Cited

U.S. PATENT DOCUMENTS

| | | | | | |
|---|---|---|---|---|---|
| 49,305 | A | * | 8/1865 | Ruggles | 24/108 |
| 327,101 | A | | 9/1885 | Palmer | 24/113 R |
| 341,418 | A | | 5/1886 | Huff | 24/104 |
| 426,999 | A | * | 4/1890 | Lewis | 24/108 |
| 437,874 | A | | 10/1890 | Traut | 24/105 |
| 487,344 | A | * | 12/1892 | Capewell | 24/108 |
| 522,239 | A | | 7/1894 | Shipley et al. | 24/95 |
| 547,424 | A | * | 10/1895 | Eaton | 24/104 X |
| 593,221 | A | | 11/1897 | Howell et al. | 24/707.5 |
| 671,959 | A | * | 4/1901 | Haverly | 24/108 |
| 838,970 | A | * | 12/1906 | Flade | 24/106 |
| 857,917 | A | | 6/1907 | Alz | 24/105 |
| 904,356 | A | | 11/1908 | Olsen | 24/707.5 |
| 999,079 | A | | 7/1911 | Worzen | 24/707.5 |
| 1,023,663 | A | | 4/1912 | Kuzicek | 24/707.5 |
| 1,027,651 | A | | 5/1912 | Heavenrich | 24/707.5 |
| 1,058,914 | A | | 4/1913 | Simmonds | 24/651 |
| 1,278,337 | A | * | 9/1918 | Hall | 24/101 R X |
| 1,324,466 | A | | 12/1919 | Pirro | 24/705 |
| 1,336,243 | A | * | 4/1920 | Lee | 24/108 |
| 1,358,465 | A | | 11/1920 | Reston | 24/66.6 |
| 1,442,824 | A | | 1/1923 | Renault | 24/707.5 |
| 1,452,052 | A | | 4/1923 | Nalle | 24/114.4 |
| 1,489,778 | A | | 4/1924 | Merzinger | 24/108 |
| 1,594,416 | A | | 8/1926 | Kellog | 24/105 |
| 1,682,771 | A | | 9/1928 | Butler | 24/105 |
| 1,690,561 | A | | 11/1928 | Sturton | 24/114.05 |
| 2,075,722 | A | | 3/1937 | Illsche | 24/105 |
| 2,127,363 | A | | 8/1938 | Illsche | 24/105 |

(List continued on next page.)

FOREIGN PATENT DOCUMENTS

| | | | | |
|---|---|---|---|---|
| AT | 203770 | | 11/1958 | 24/113 R |
| FR | 2 623 698 A1 | * | 6/1989 | 63/12 |

OTHER PUBLICATIONS

*Official Gazette,* Nov. 13, 1990, abstract of U.S. Patent No. 4,969,241, Jetta R. Griffin.

*Primary Examiner*—Robert J. Sandy
*Assistant Examiner*—Ruth C. Rodriguez
(74) *Attorney, Agent, or Firm*—Stoll, Keenon & Park, LLP

(57) ABSTRACT

An attachment device or replacement button device for mounting on at least one piece of pliant material includes a carrier member having a carrier head and a carrier shank extending outwardly from the carrier head. The carrier shank includes a piercing point and a joining region exists between the carrier head and the carrier shank with the joining region having a curved portion with a predefined radius. A receiver is provided for receiving the carrier shank and retaining the carrier member in a mated relationship with the receiver. The receiver includes a smooth receiver head for non-abrasive contact with a user and a receiver shank extends outwardly from the receiver head to define a receiving well for receipt of the carrier shank. The devices are mated by a friction fit and the receiver shank length combines with the carrier shank length to provide a predetermined spacing between the carrier head and the receiver head to allow the device to be operated in the manner of a conventional button.

21 Claims, 4 Drawing Sheets

U.S. PATENT DOCUMENTS

| | | | | | |
|---|---|---|---|---|---|
| 2,308,424 | A | | 1/1943 | Morehouse | 24/707.5 |
| 2,372,922 | A | | 4/1945 | Winters | 24/707.5 |
| 2,436,323 | A | | 2/1948 | Nygard | 24/105 |
| 2,462,332 | A | | 2/1949 | Neumann | 24/104 |
| 2,538,396 | A | | 1/1951 | Sutin | 24/108 |
| 3,141,211 | A | * | 7/1964 | Blake | 24/114.9 |
| 3,341,904 | A | | 9/1967 | Joyner et al. | 24/114.3 |
| 3,500,507 | A | * | 3/1970 | Malhenzie et al. | 24/113 MP |
| 3,689,962 | A | * | 9/1972 | Erickson | 24/108 |
| 3,691,597 | A | * | 9/1972 | Kahn | 24/108 |
| 3,735,447 | A | | 5/1973 | Abraham | 24/6 |
| 3,934,314 | A | | 1/1976 | Whysall | 24/113 R |
| 4,169,302 | A | | 10/1979 | Ferguson | 24/113 R |
| 4,198,733 | A | | 4/1980 | Ferguson et al. | 24/113 R |
| 4,242,886 | A | * | 1/1981 | Tucker | 63/14.3 |
| 4,283,815 | A | | 8/1981 | Henshaw | 24/114.3 |
| 4,344,240 | A | * | 8/1982 | Schiller | 24/108 X |
| 4,387,488 | A | | 6/1983 | Kanzaka | 24/113 R |
| 4,481,696 | A | * | 11/1984 | Kanzaka | 24/113 R |
| 4,495,678 | A | | 1/1985 | Coley | 24/113 R |
| 4,507,344 | A | * | 3/1985 | Baughman | 428/99 |
| 4,507,817 | A | | 4/1985 | Staffeld | 7/158 |
| 4,580,320 | A | | 4/1986 | Takata | 24/113 MP |
| 4,630,453 | A | | 12/1986 | Burkett | 63/12 |
| 4,662,033 | A | | 5/1987 | Wieland, Jr. et al. | 24/90 R |
| 4,662,034 | A | | 5/1987 | Cunningham | 24/90 R |
| 4,782,559 | A | * | 11/1988 | Sparrow | 24/113 MP |
| 4,788,753 | A | * | 12/1988 | Sparrow et al. | 24/113 MP |
| 4,794,672 | A | | 1/1989 | Olovson | 24/112 |
| 4,928,362 | A | * | 5/1990 | Collas et al. | 24/90 R |
| 4,941,234 | A | | 7/1990 | Watanabe et al. | 24/113 MP |
| 5,107,573 | A | | 4/1992 | Zhang | 24/706.4 |
| 5,411,516 | A | * | 5/1995 | Thomas | 606/108 |
| 5,467,510 | A | * | 11/1995 | Hartzell | 24/706.9 |
| 5,517,730 | A | | 5/1996 | Ho | 24/92 |
| 5,542,157 | A | * | 8/1996 | Herman | 24/113 MP |
| 5,593,410 | A | | 1/1997 | Vrespa | 606/73 |
| 5,603,143 | A | | 2/1997 | Rucker | 24/90.1 |
| 5,606,780 | A | * | 3/1997 | Kusano | 24/105 |
| 5,607,428 | A | | 3/1997 | Lin | 606/69 |
| 5,743,113 | A | * | 4/1998 | Kogen | 63/12 |

* cited by examiner

ATTACHMENT DEVICE FOR PLIANT MATERIAL

BACKGROUND OF THE INVENTION

The present invention relates broadly to fasteners in the nature of clothing fasteners and, more particularly, to an attachment device that may be attached to pliant material, such as fabric, and that can be used for releaseably attaching two pieces of pliant material together.

One common method of closing articles of clothing being worn is a button. Buttons, as commonly known, are small discs having channels extending through the body of the disk so that the button may be stitched to a piece of pliant material, such as fabric. As is also generally known, corresponding button holes are formed on opposing pieces of fabric so that the button may be passed laterally through the button hole and thereby retain the clothing in a closed condition.

Button failure typically occurs when the button disc breaks or the thread becomes loose or breaks. It is an inconvenient process to obtain a needle and thread, a new button, and stitch the button to the cloth. Often, the inconvenience is exacerbated by the immediate demands on the user of the clothing. The problem of replacing buttons, in lieu of resewing, has been addressed in the past by essentially taking a tie-tack structure and applying a conventional button to the outer surface of the tie tack. Such tie-tack style replacement buttons typically include a metal shaft and a metal, spring biased clasp for removable attachment to the shaft.

Such tie-tack type replacement button structures have several disadvantages. First, the tie tack type replacement buttons do not function as a button, but rather in the manner of a tie-tack, by first using the shaft to join two pieces of fabric together, then applying the clasp. Accordingly, the outer fabric portion must be first joined to the inner fabric portion and the shaft of the tie-tack structure, passed through the two fabric portions. The user must then, somehow, attach the clasp behind both fabric portions which would entail reaching into a shirt, for example, if the button were applied to the front of a shirt. If the button were to be applied to a shirt cuff, the shirt would likely have to be removed before the tie-tack type replacement button could be attached.

Secondly, the metal clasp in these tie-tack type arrangements often exposes the sharp tip of the shaft to the users skin, or fabric and even if the tip is not exposed, the metal clasp usually has sharp edges that can cut or irritate either the skin, the fabric or both.

Finally, these tie-tack type arrangements are often made from dissimilar materials which may include a plastic button with a metal shank and metal clasp. Such dissimilar materials add expense and difficulty to the manufacturing process.

This type of attachment arrangement is also present on devices which are not intended to attach clothing together, but rather to attach something to a piece of clothing, such as a name tag, military ribbon, badge, or the like. The above-described difficulties can also apply to such an attachment structure.

Accordingly, there exists a need for a replacement button or attachment device for attachment to one or more pieces of fabric that can be easily attached, easily manufactured, in the case of a button, can be operated in the manner of a conventional button.

SUMMARY OF THE INVENTION

It is accordingly an object of the present invention to provide an attachment device, which may be in the form of a replacement button, that may be easily attached to a piece of pliant material, such as a textile fabric and can be operated in the manner of a conventional button.

It is also an object of the present invention to provide an attachment device, that may be in the form of a replacement button, and that may be easily molded from plastic thereby enhancing the ease of manufacturing such a device.

It is another object of the present invention to provide an attachment device, that may be in the form of a replacement button that presents no sharp edges to the user or the users clothing, and therefore is non-abrasive to the user or the user's clothing.

To those ends, an attachment device for mounting on at least one piece of pliant material includes a carrier member having a carrier head formed with a first carrier surface and a second carrier surface disposed oppositely from the first carrier surface. A carrier shank extends outwardly from the second carrier surface with the carrier shank including a tapered end portion defining a piercing point. A joining region is provided that extends between the second carrier surface and the carrier shank, with the joining region including a curved portion having a predefined radius.

A receiver is provided for receiving the carrier shank and retaining the carrier member in a mated relationship with the receiver. The receiver includes a receiver head having a first receiver surface and a second receiver surface disposed oppositely from the first receiver surface. A receiver shank extends outwardly from the first receiver surface to define a distal end of the receiver shank. The receiver shank includes a receiving well formed therein with an access opening being defined at the distal end for gripping receipt of the carrier shank in the receiving well. The combination of the receiver shank length and the carrier shank length when the carrier and receiver are mated provide a predetermined spacing between the carrier head and the receiver head. The mated relationship is maintained by frictional contact between the carrier shank and the inner walls of the receiving well.

It is preferred that the receiver is formed with a joining region extending between the first surface of the receiver head and the receiver shank with the joining region including a curved portion having a predefined radius.

Preferably, the receiver head is formed as a generally circular member having opposing indentations formed therein to interrupt the curvature and facilitate manual gripping of the receiver. It is further preferred that the receiver head be formed with a domed surface. Preferably, the domed surface of the receiver head includes opposing indentations formed therein to facilitate manual gripping of the receiver.

It is preferred that the carrier head is formed with a domed surface. It is also preferred that the carrier head be formed with at least one channel extending therethrough. Preferably, the attachment device further preferably includes an ornamental member attached to the carrier head with the ornamental member having a decorative surface and a mating surface and at least one mating shank projecting from the mating surface for receipt in the at least one channel for facilitating attachment of the ornamental member of the carrier head. In another embodiment, the ornamental member includes a decorative surface and a mating surface with the mating surface extending beyond the carrier head and including a flange for engagement of the carrier head to facilitate attachment of the ornamental member to the carrier head.

Preferably, an ornamental member is attached to the carrier head with an ornamental member being formed to resemble a button. Alternatively, the carrier head may be formed to resemble a button. In another alternate embodiment, the carrier head includes an indicia carrying surface. Alternately, the ornamental member attached to the carrier head may include an indicia carrying surface.

The present invention may further include a second carrier shank projecting from the second carrier surface and the second receiver for mating with the second carrier shank. The second receiver shank includes a receiving well formed therein with an access opening being defined at the distal end for gripping receipt of the second carrier shank in the receiving well. The combination of the second receiver shank length and the carrier shank length when the carrier and receivers are mated provide a predetermined spacing between the carrier head and the receiver head.

The present invention may also be in the form of a replacement button device for a joining at least two pieces of pliant material. The replacement button device preferably includes a button member having a button head formed with a first button surface, the first button surface being configured to resemble a button; and a second button surface disposed oppositely from the first button surface. A button member shank is provided and extends outwardly from the second button surface. The button member shank includes a tapered end portion providing a piercing point. A joining region is provided and extends between the second button surface and the button member shank with the joining region including a curved portion having a predefined radius. A receiver is provided for receiving the button member shank and retaining the button member in a mated relationship with the receiver. The receiver includes a receiver head having a first receiver surface and a second receiver surface disposed oppositely from the first receiver surface. A receiver shank extends outwardly from the first receiver surface to define a distal end of the receiver shank. The receiver shank includes a receiving well formed therein with an access opening being defined at the distal end for gripping receipt of the button member shank in the receiving well. The combination of the receiver shank length and the button member shank length when the carrier and receiver are mated provide a predetermined spacing between the carrier head and the receiver head Preferably, the receiver is formed with a joining region extending between the first surface of the receiver head and the receiver shank with the joining region including a curved portion having a predefined radius. It is further preferred that the receiver head be formed as a generally circular member having opposing indentations formed therein to interrupt the curvature and facilitate manual gripping of the receiver. Preferably, the receiver is formed with a domed surface. The domed surface may include opposing indentations formed therein to facilitate manual gripping of the receiver.

Another embodiment of the present invention may be described as a replacement button device having interchangeable ornamental button members. To provide this, a replacement button device for adjoining at least two pieces of pliant material includes a button member having a button head formed with the first button surface and a second button surface disposed oppositely from the first button surface. A button member shank is included that extends outwardly from the second button surface with the button member shank including a tapered end portion defining a piercing point. A joining region is provided and extends between the second button surface and the button member shank, the joining region including a curved portion having a predefined radius.

A receiver is provided for receiving the button member shank and retaining the button member in a mated relationship with the receiver. The receiver includes a receiver head having a first receiver surface and a second receiver surface disposed oppositely from the first receiver surface. A receiver shank extends outwardly from the first receiver surface to define a distal end of the receiver shank. The receiver shank includes a receiving well formed therein with an access opening being defined at the distal end for gripping receipt of the button member shank in the receiving well. The combination of the receiver shank length and the carrier shank length when the carrier and receiver are mated provide a predetermined spacing between the carrier head and the receiver head. Preferably, the receiver is formed with a joining region, extending between the first surface of the receiver head and the receiver shank. The joining region includes a curved portion having a predefined radius. Preferably, the receiver head is formed as a generally circular member having opposing indentations formed therein to facilitate manual gripping of the receiver. It is further preferred that the receiver head be formed with a domed surface. Further, the domed surface may include opposing indentations formed therein to interrupt the curvature and facilitate manual gripping of the receiver.

Preferably, the button member head is formed with a domed surface. The button member head may also be formed with at least one channel extended therethrough.

The present invention further preferably includes an ornamental button member configured to resemble a button attached to the button head, the ornamental button member having a presentation surface and a mating surface. At least one mating shank projects from the mating surface for receipt in the at least one channel for facilitating attachment of the ornamental button member to the button head. Optionally, the mating surface may extend beyond the button head and include a flange for engagement of the button head to facilitate attachment of the ornamental button member to the button head.

By the above, the present invention provides a replacement button device or attachment device that is easy to manufacture and may be easily attached to a pliant material, such as fabric. The present invention also provides the ability to function like a button in that the device can be attached to a first material portion and used in the manner of a button to attach a second material portion to the first, with the second material portion having a button hole.

DESCRIPTION OF THE PREFERRED EMBODIMENT

Figure 1:
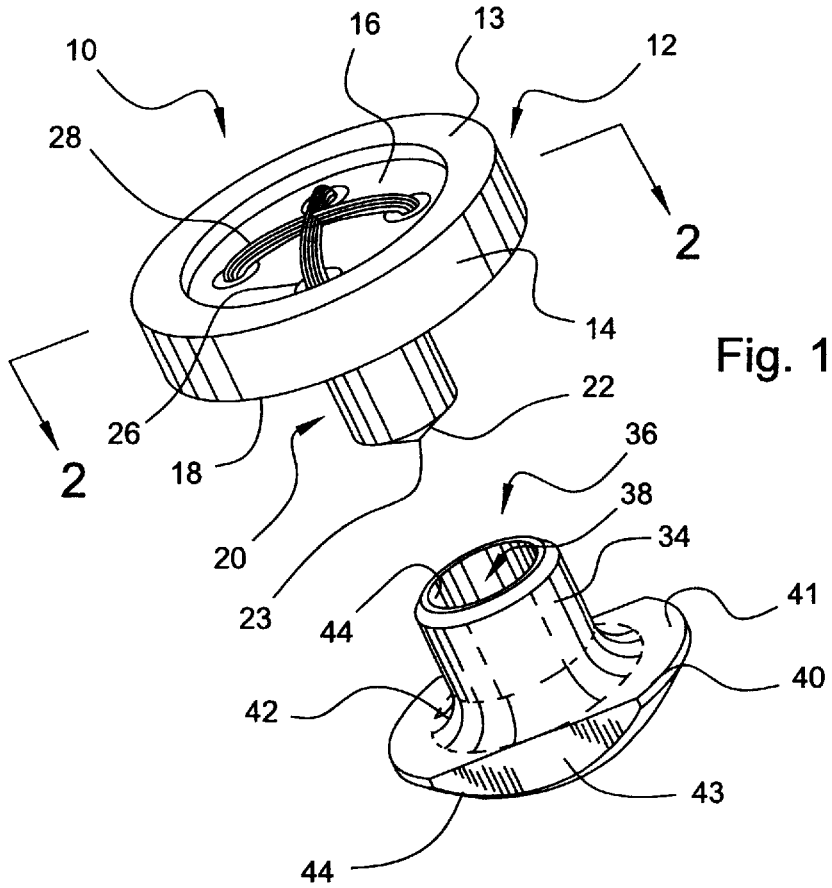
FIG. 1 is a perspective, exploded view of an attachment device according to the preferred embodiment of the present invention.
Figure 2:
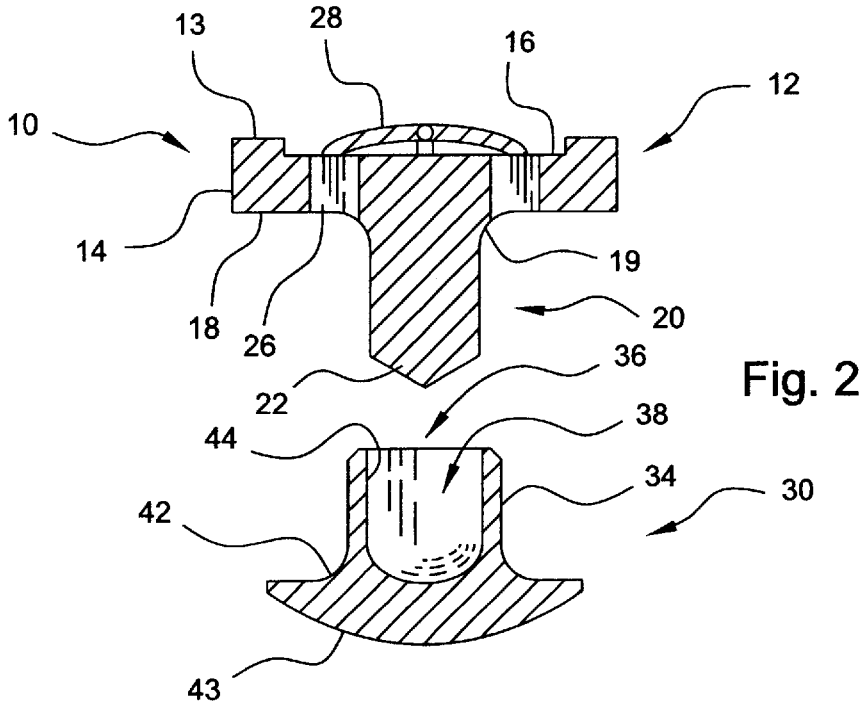
FIG. 2 is a side cut-away view of the attachment device depicted in FIG. 1, taken along line 2–2 thereof.

Turning now to the drawings and, more particularly, to FIG. 1, an attachment device in the form of a replacement button device is illustrated generally at 10 and includes a carrier 12 and a receiver 30. The carrier 12 includes a carrier head 14 attached to a carrier shank 20. The carrier head 14 includes a first, outer surface 16 and a second, inner surface 18 and is formed as a disc-like member. In one preferred embodiment of the present invention, the carrier head 14 is configured to resemble a button, particularly a shirt button. In that regard, and as seen in FIGS. 1 and 2, a raised rim 13 extends around the perimeter of the carrier head 14. Four channels 26 are formed in the carrier head and extend therethrough. The use of four channels 26 is to enhance the resemblance to a button, but it should be noted that the present invention should not be limited to any number of channels. A thread-like body 28 extends between the channels 26 to give the appearance of actual thread. The thread-like body 28 may be molded or may actually be fibrous thread.

The carrier shank 20 is formed as an elongate cylinder and is preferably molded with the carrier head 12. The carrier shank 20 includes a tapered end 22 which terminates in a piercing point 23. The piercing point 23 and the taper of the tip 22 act to separate threads in the cloth rather than tearing through and breaking threads. The carrier shank 20 and the carrier head 14 are joined at a joining region 24 having a curved radius. The smoothly curved joining region 24 acts to resist any tendency of the carrier head 41 to break free from the carrier shank 20. The radius of the joining region 24 is predefined for manufacture but may occupy a wide range of curvature.

The receiver 30 includes a receiver body 40 having a receiver shank 34 mounted thereto. The receiver shank 34 is mounted to a first surface 41 of the receiver body 40 at a joining region 42. The joining region 42, as seen in FIGS. 1 and 2, includes a curved region that allows the replacement button device 10 move smoothly against a piece of pliant material in contact with the first receiver surface 41.

Figure 3:
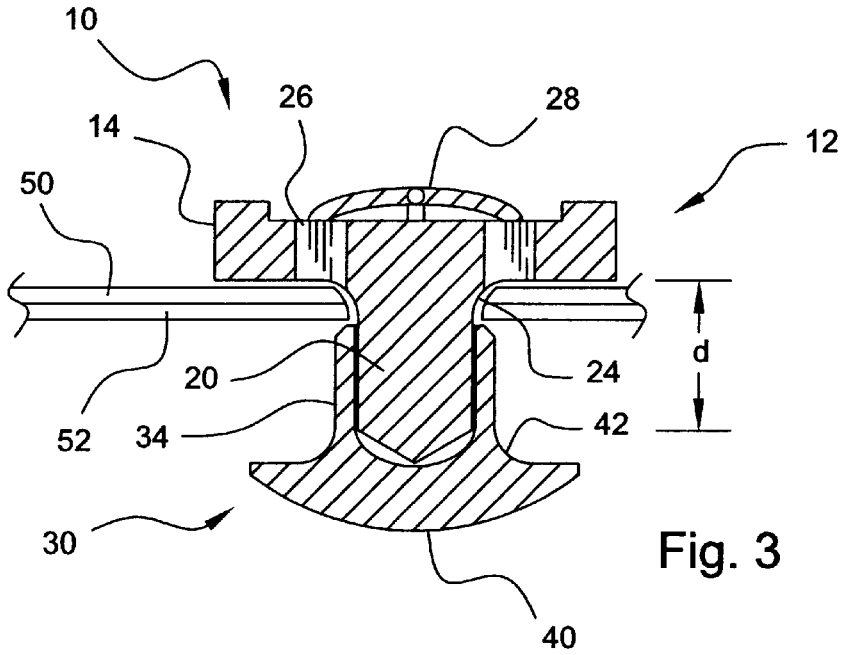
FIG. 3 is a side cut-away view of the attachment device depicted in FIG. 1, taken along line 2–2 thereof, in a mated condition.

The receiver shank 34 is formed as a generally hollow cylinder defining a receiving well 38 therein. The receiving well 38 terminates at an outer end of the receiver shank 34 to define a receiving opening 36 thereat. The inner walls 44 of the receiver shank 34 provide a friction surface such that when the carrier head 12 is mated to the receiver 30, friction between the carrier shank 20 and the inner walls 44 of the receiver shank 34 retain the carrier head in place as seen in FIG. 3. Referring back to FIGS. 1 and 2, the receiver body includes a domed second surface 43 which provides a smooth surface for non-abrasive contact against the body or clothing of a user. The receiver body 30 has a generally circular curvature to its rim. The curvature is interrupted to define two indentations 44 on either side of the receiver body for enhanced gripping to facilitate manual attachment and removal of the receiver 30.

Turning now to FIG. 3, the replacement button device 10 is illustrated and used to attach two pieces of pliant material 50, 52, together. It should be noted that the pliant material may be fabric or any other material adaptable to the present replacement button device 10. Further, although the first material 50 and the second material 52 are illustrated in complete, smooth abutment, the illustration is for information purposes only and do not necessarily reflect the true nature of fabric joined by a button which may be far more wrinkled than illustrated.

The receiver shank 34 length is combined with the carrier shank 20 length to define a distance d, extending between the carrier head 14 and the receiver head 40. This distance d allows sufficient freedom of movement so that the device might be joined to the first inner fabric portion 52 and then used in the manner of a button to allow the carrier head 14 to move through a button hole in a second outer material portion 50.

In operation, and with reference to FIGS. 1, 2 and 3, when the device is to be used as a replacement button, the receiver 30 and carrier member 12 are separated as seen in FIG. 1. A first, inner material portion 52, as seen in FIG. 3 will typically have a button missing therefrom. The location of this missing button can be presumed to correspond with the buttonhole in a second, outer fabric 50. The carrier member 12 is attached to the receiver 30 by pushing the carrier shank 20 through the inner fabric 52. The piercing point will separate threads rather than tearing or rending the fabric. Once the carrier 12 is in place, the receiver 30 is fitted to the carrier shank with the carrier shank 20 inserted in the receiving well 38. Friction between the carrier shank 20 and the inner walls 44 of the receiving well 38 cause the carrier 12 to remain mated with the receiver 30 until forced separation. The distance d between the carrier head 14 and the receiver 30 allows movement longitudinally with respect to the carrier shank 20 such that the device may be used as a conventional button. The carrier head 14 is then inserted laterally through a buttonhole in the outer fabric 50 and is used in a manner depicted in FIG. 3 to retain the two fabric pieces 50, 52 in a mated relationship. As will be understood, when the device is used as an attachment device as explained in greater detail hereinafter, essentially the same operation is used while omitting the buttoning step.

Figure 4:
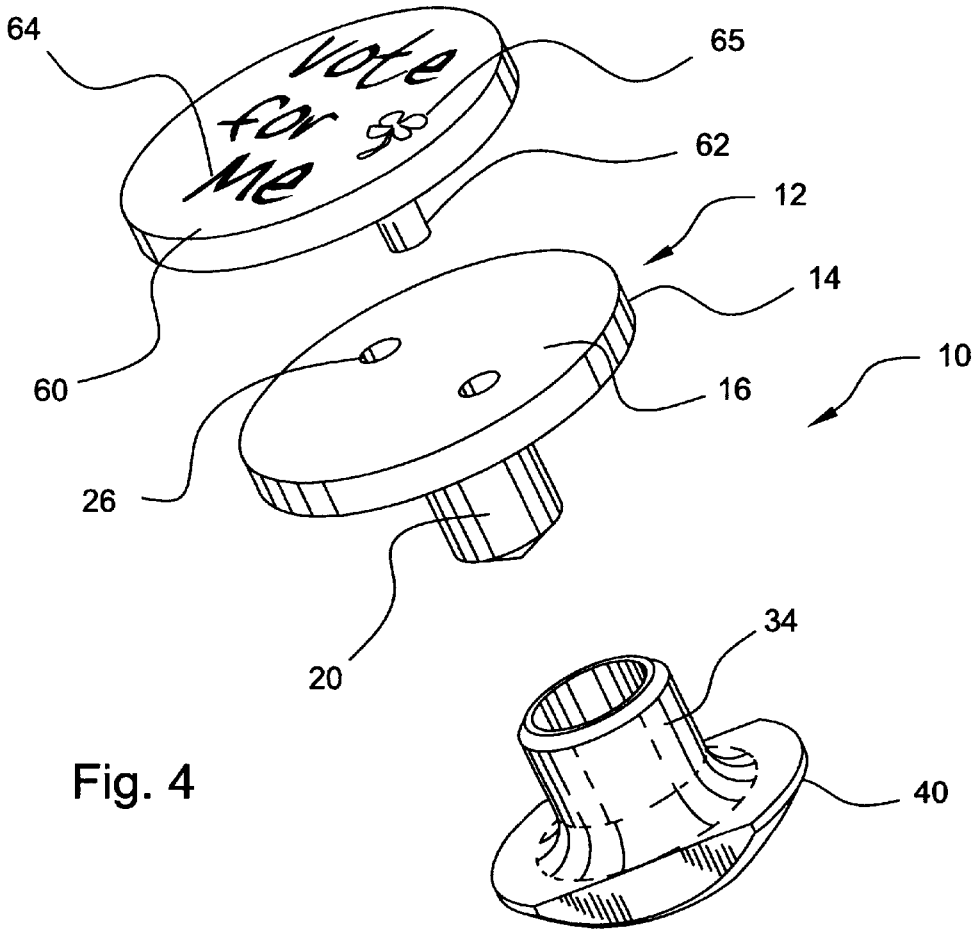
FIG. 4 is a perspective, exploded view of an attachment device according to a second preferred embodiment of the present invention.

Another preferred embodiment of the invention is illustrated in FIG. 4. There, the carrier head 14 is formed as a flat disc having two channels 26 extending therethrough. The flat disc of the carrier head 14 allows the device to function as a carrier of an ornamental member 60 as illustrated in FIG. 4. The ornamental member 60 may optionally carry indicia 64 or other ornamentation 65 and may be interchangeable. Shanks 62 extend outwardly from an inner surface of the ornamental member 60 for engagement with corresponding channels 26 in the carrier head 14. The channels 26 provide an adhesive holding region such that the ornamental member 60 may be attached to the carrier head 14 by adhesive, or may be attached and regained by friction.

Figure 5:
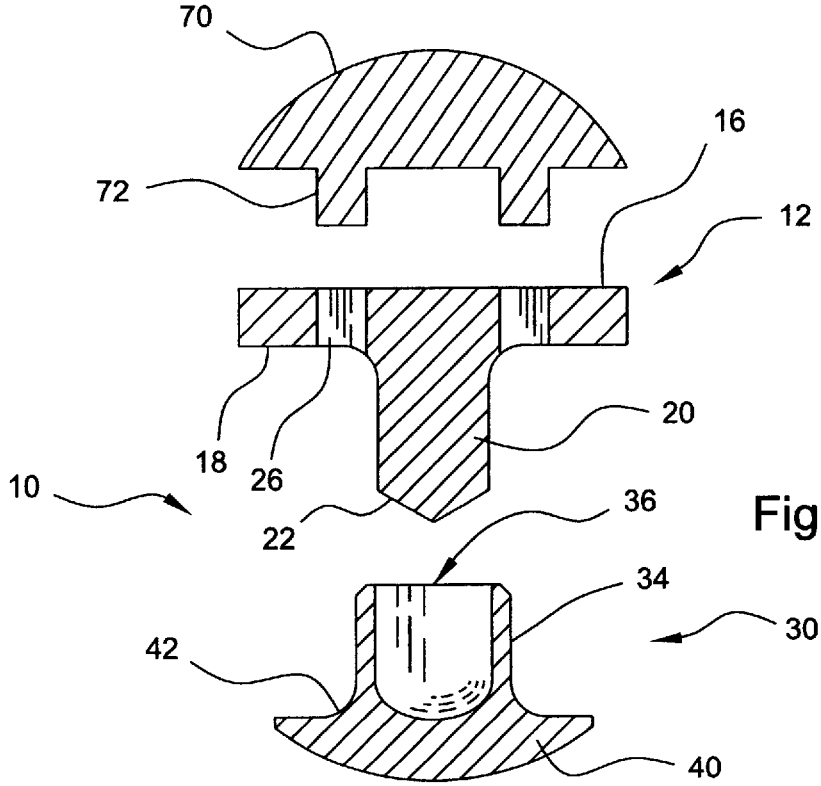
FIG. 5 is a side cut-away view of an attachment device according to another preferred embodiment of the present invention.
Figure 6:
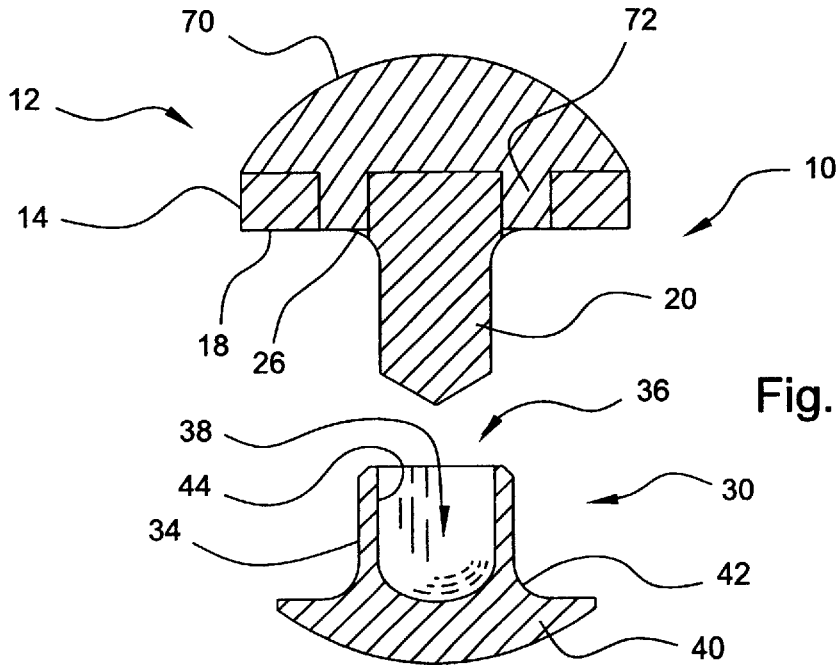
FIG. 6 is a side cut-away view of an attachment device as illustrated in FIG. 5.
Figure 7:
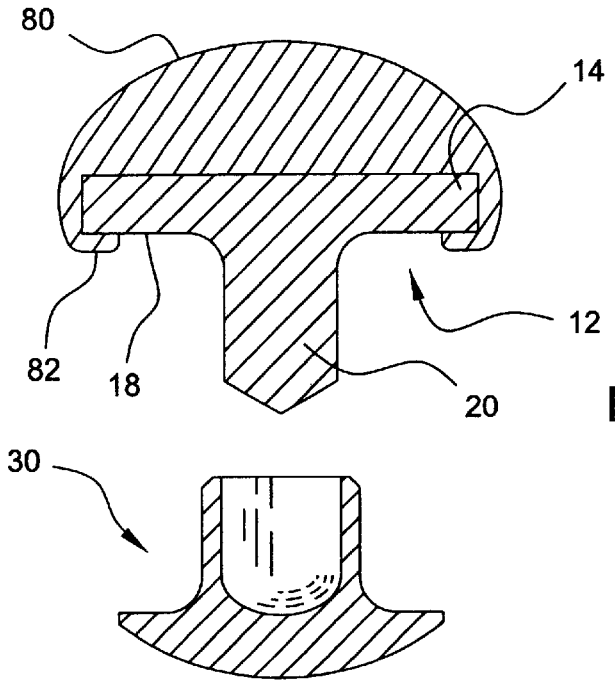
FIG. 7 is a side cut-away view of an attachment device according to another preferred embodiment of the present invention.

Turning now to FIG. 5, the ornamental member 70 may be formed as a domed member and, may be formed of virtually any decorative shape. Shanks 72 extend downwardly from the domed member 70 for engagement with the channels 26 in a manner illustrated in FIG. 6. FIG. 6 illustrates the domed ornamental member 70 mounted to the carrier head 14. Once again, the channels 26 may be used as adhesive holding regions. An alternate mounting arrangement is illustrated in FIG. 7. There, a domed ornamental member 80 is illustrated which extends beyond the diametrical extent of the carrier head 14. One or more flanges 82 may be formed on the domed member 80 which may be formed from a flexible material for engagement of the sides and second carrier surface 18 of the carrier head 14. Interchangeability of the ornamental member 80 is achieved by the snap-on nature of the flange mounting arrangement.

Figure 8:
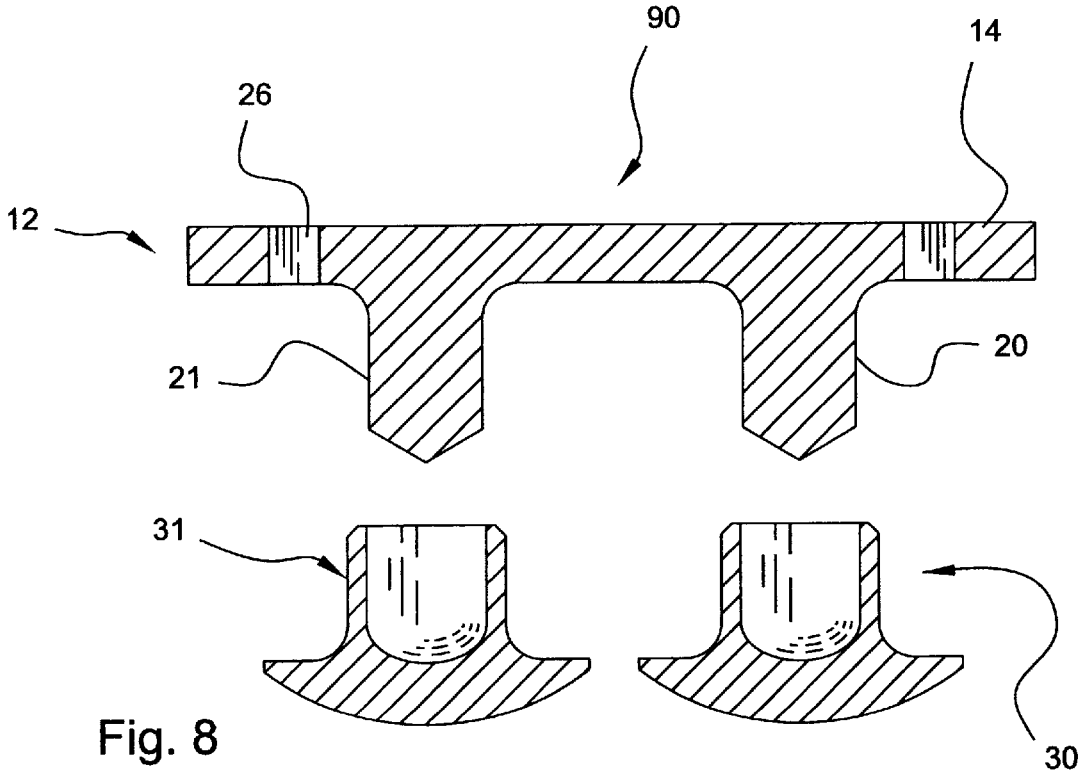
FIG. 8 is a side cut-away view of an attachment device according to another preferred embodiment of the present invention.

Another embodiment of the present invention is illustrated in FIG. 8. This embodiment may be useful as an attachment device for holding name tags or the like to fabric. There, an attachment device is illustrated generally at 90 having a carrier head 14 similar to the carrier head illustrated in FIG. 1. A first shank 20 projects away from an under surface of the carrier head 14 and a second parallely oriented shank 21 also projects away from the carrier head 14. First and second receivers, 30 and 31 are provided for engagement with the first and second shanks 20, 21. The addition of the second shank 21 and second receiver 31 provide stability to carrier heads that may not be circular and may be larger than conventional buttons.

As has been seen above, the present invention provides an attachment device or replacement button device that is easy to manufacture and convenient to use. The device may be molded from plastic or other material and is essential unitary in material usage which facilitates ease of manufacturing. Additionally, the curvature of the shank joining regions provide strength against snapping of the carrier head or the receiver head away from the respective shanks. A molded version of the device is non-abrasive and in addition to the non-abrasive nature of the material, the curvature of the receiver head provides non-abrasive contact to the clothing or body of a user.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An attachment device for mounting on at least one piece of pliant material, said attachment device comprising:

a carrier member having a carrier head formed with a first carrier surface, a second carrier surface disposed oppositely from said first carrier surface and at least one channel extending therethrough; a carrier shank extending outwardly from said second carrier surface, said carrier shank including a tapered end portion defining a piercing point; and a joining region extending between said second carrier surface and said carrier shank, said joining region including a curved portion having a predefined radius and extending circumferentially around said shank; and a receiver for receiving said carrier shank and retaining said carrier member in a mated relationship with said receiver, said receiver including a receiver head having a first receiver surface and a second receiver surface disposed oppositely from said first receiver surface to define a distal end of said receiver shank, said receiver shank having a receiving well formed therein with an access opening being defined at said distal end for gripping receipt of said carrier shank in said receiving well, said receiver shank combining with said carrier shank when said receiver and said carrier member are mated to provide a variable spacing between said second carrier surface and said first receiver surface when said carrier member and said receiver are mated.

2. An attachment device according to claim 1 wherein said first receiver surface and said second receiver surface meet at a rim and wherein said receiver is formed with a joining region extending between said first surface of said receiver head and said receiver shank, said joining region including a curved portion having a predefined radius, with an entirety of said curved portion extending beyond said rim.

3. An attachment device according to claim 1 wherein said receiver head is formed as a generally circular member having opposing indentations formed therein to interrupt circular curvature and facilitate manual gripping of said receiver.

4. An attachment device according to claim 1 wherein said receiver head is formed with a domed surface.

5. An attachment device according to claim 1 wherein said carrier head is formed with a domed surface.

6. An attachment device according to claim 1 and further comprising an ornamental member attached to said carrier head, said ornamental member having a decorative surface and a mating surface; and at least one mating shank projecting from said mating surface for receipt in said at least one channel for facilitating attachment of said ornamental member to said carrier head.

7. An attachment device according to claim 1 and further comprising an ornamental member attached to said carrier head, said ornamental member having a decorative surface and a mating surface; said mating surface extending beyond said carrier head and including a flange for engagement of said carrier head to facilitate attachment of said ornamental member to said carrier head.

8. An attachment device according to claim 1 and further comprising an ornamental member attached to said carrier head, said ornamental member being formed to resemble a button.

9. An attachment device according to claim 1 wherein said carrier head is formed to resemble a button.

10. An attachment device according to claim 1 wherein said carrier head includes an indicia carrying surface.

11. An attachment device according to claim 1 and further comprising an ornamental member attached to said carrier head, said ornamental member including an indicia carrying surface.

12. An attachment device according to claim 1 and further comprising a second carrier shank projecting from said second carrier surface and a second receiver for mating with said second carrier shank, said second receiver shank having a receiving well formed therein with an access opening being defined at said distal end for gripping receipt of said second carrier shank in said receiving well, said receiver shank combining with said carrier shank when said second receiver and said carrier are mated to provide a predetermined spacing between said second carrier surface and said first receiver surface when said carrier and said second receiver are mated.

13. An attachment device according to claim 1 wherein said joining region curved portion includes said predefined radius extending circumferentially around said shank.

14. An replacement button device for joining at least two pieces of pliant material, said replacement button device comprising:

a button member having a button head formed with a first button surface, a second button surface disposed oppositely from said first button surface and at least one channel extending therethrough; a button member shank extending outwardly from said second button surface, said button member shank including a tapered end portion defining a piercing point; and a joining region extending between said second button surface and said button member shank, said joining region including a curved portion having a predefined radius and extending circumferentially around said shank; and a receiver for receiving said button member shank and retaining said button member in a mated relationship with said receiver, said receiver including a receiver head having a first receiver surface and a second receiver surface disposed oppositely from said first receiver surface to define a distal end of said receiver shank, said receiver shank having a receiving well formed therein with an access opening being defined at said distal end for gripping receipt of said button member shank in said receiving well, said receiver shank combining with said button member shank when said receiver and said button member are mated to provide a variable spacing between said second button surface and said first receiver surface when said button member and said receiver are mated.

15. An replacement button device according to claim 14 wherein said first receiver surface and said second receiver surface meet at a rim and wherein said receiver is formed with a joining region extending between said first surface of said receiver head and said receiver shank, said joining region including a curved portion having a predefined radius, with an entirety of said curved portion extending beyond said rim.

16. A replacement button device according to claim 14 wherein said receiver head is formed as a generally circular member having opposing indentations formed therein to interrupt circular curvature and facilitate manual gripping of said receiver.

17. A replacement button device according to claim 14 wherein said receiver head is formed with a domed surface.

18. A replacement button device according to claim 14 wherein said button member head is formed with a domed surface.

19. A replacement button device according to claim 14 and further comprising an ornamental button member configured to resemble a button attached to said button head, said ornamental button member having a presentation surface and a mating surface; and at least one mating shank projecting from said mating surface for receipt in said at least one channel for facilitating attachment of said ornamental button member to said button head.

20. A replacement button device according to claim 14 and further comprising an ornamental button member configured to resemble a button attached to said button head, said ornamental button member having a presentation surface and a mating surface; said mating surface extending beyond said button head and including a flange for engagement of said button head to facilitate attachment of said ornamental button member to said button head.

21. A replacement button device according to claim 14 wherein said joining region curved portion includes said predefined radius extending circumferentially around said shank.

* * * * *